US006797947B2

(12) United States Patent
Russ, IV et al.

(10) Patent No.: US 6,797,947 B2
(45) **Date of Patent: *Sep. 28, 2004**

(54) INTERNAL INTRODUCTION OF LOCK MASSES IN MASS SPECTROMETER SYSTEMS

(75) Inventors: Charles W. Russ, IV, Sunnyvale, CA (US); Steven M. Fischer, Hayward, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/664,512

(22) Filed: Sep. 16, 2003

(65) Prior Publication Data

US 2004/0051039 A1 Mar. 18, 2004

Related U.S. Application Data

(63) Continuation of application No. 10/081,780, filed on Feb. 20, 2002, now Pat. No. 6,649,909.

(51) Int. Cl.[7] ..... H01J 49/10
(52) U.S. Cl. ..... 250/288; 250/282; 250/281
(58) Field of Search ..... 280/281, 288, 280/282, 286, 287

(56) References Cited

U.S. PATENT DOCUMENTS 3,920,986 A * 11/1975 Fies, Jr. ..... 250/282
6,331,702 B1 * 12/2001 Krutchinsky et al. ..... 250/281
6,504,150 B1 * 1/2003 Verentchikov et al. ..... 250/286
6,649,909 B2 * 11/2003 Russ et al. ..... 250/288

* cited by examiner

*Primary Examiner*—John R. Lee
*Assistant Examiner*—Johnnie L Smith, II

(57) ABSTRACT

An apparatus and method for calibrating a mass spectrometer by internally introducing calibration masses at a post-source stage of the mass spectrometer is provided. A source of lock mass ions adjacent the ion optics creates lock mass ions within the ion optics. Lock mass ions mix with the analyte ions in the ion optics prior to mass analysis. The source of lock mass ions may include various means for ionizing lock mass molecules including but not limited to photoionization, field desorption-ionization, electron ionization, and thermal ionization means. An apparatus and method of mass calibrating a tandem mass spectrometer is also provided. The mass calibration apparatus includes a collision cell for fragmenting analyte ions and a source of lock mass ions adjacent said collision cell for creating lock mass ions in the collision cell.

10 Claims, 5 Drawing Sheets

INTERNAL INTRODUCTION OF LOCK MASSES IN MASS SPECTROMETER SYSTEMS

RELATED APPLICATIONS

This application is a continuation of U.S. patent application Ser. No. 10/081,780, filed Feb. 20, 2002 now U.S. Pat. No. 6,649,909.

FIELD OF THE INVENTION

The present invention relates to mass spectroscopy systems, and more particularly, but without limitation, relates to an apparatus and method for calibrating a mass spectrometer by internally introducing calibration masses at a post-source stage of the mass spectrometer.

BACKGROUND INFORMATION

For many years, mass spectrometers have proved to be a valuable tool for analyzing the chemical composition of complex mixtures of substances. Constituent molecules are ionized and then differentiated according to the ratio of their mass to their ionization charge (m/z). In recent times, numerous improvements have been made in sample preparation and ionization techniques, which collectively pertain to the "ion source" region of the mass spectrometer. Atmospheric Pressure Ionization (API) techniques, such as Electrospray (ESI), Atmospheric Pressure Chemical Ionization (APCI), Atmospheric Pressure Photoionization (APPI) and Atmospheric Pressure Matrix Assisted Laser Desorption/Ionization (AP MALDI) are now commonly used to generate analyte ions from fluid samples. These techniques have improved the sensitivity of mass spectrometer systems by increasing the concentration of ionized analyte molecules that enter the mass spectrometer and reach detectors downstream.

In Electrospray sources, an analyte solution from a source apparatus, such as a liquid chromatography column, is ejected from a needle as a liquid stream. Instabilities in the liquid stream generated by nebulizing means such as a nebulizing gas, pneumatic assist and/or ultrasonic waves result in breakup of the stream into droplets, many of which bear electric charge as a result of the needle being at high potential with respect to surrounding conductors, or due to triboelectric effects. The charged droplets are desolvated by evaporation, freeing desolvated, ionized analyte molecules. The analyte ions are then directed into a mass spectrometer interface from which the constituent molecules are transported through one or more vacuum stages downstream to a mass analyzer. At the mass analyzer the analyte ions are filtered and then detected.

Concurrent improvements in mass analysis techniques, such as Time-Of-Flight (TOF) and Magnetic Sector and Fourier Transform Ion Cyclotron Resonance (FTICR), have made mass assignment accuracies on the order of 1 to 10 ppm (parts per million) feasible. However, this level of accuracy requires a level of instrument stability and repeatability that is not always attainable due to "drift" caused by fluctuations in ambient temperature, spectrometer chamber pressures, and applied voltages. To adjust to such drift, instruments are calibrated using masses that are known, using a process referred to as mass calibration. According to this technique, known compounds, herein referred to as lock masses, having characteristic m/z ratios, are typically analyzed either in conjunction or sequentially with samples of unknown compounds (analytes). The resulting mass spectrum contains one or more internal calibration peaks corresponding to the m/z ratio of the lock masses which can then serve as a scale by which the masses of peaks corresponding to the unknown compounds can be measured. Methods for use of lock masses in calibration of analyte mass spectra are well known in the art.

In one conventional method of mass calibration, lock masses are mixed with the unknown sample in solution prior to ionization in the ion source. This conventional method suffers from the problem of contamination as the lock masses contaminate transfer lines and capillary tips, and also suppress the ionization efficiency of the sample compounds during the ionization process. At the high accuracy threshold required for distinguishing between large molecular-weight compounds, even slight instrument drift can alter analysis results, so that it is advantageous to run successive analyses at a high-throughput rate before large drift fluctuations materialize. At such high-throughput rates, lock mass contamination becomes a more important issue because the residue of the lock mass left over from previous analysis runs may be difficult to eliminate before succeeding analysis runs take place.

Recently, techniques have been developed for introducing lock masses externally from the sample, which purport to reduce the effects of contamination. In "Multiple Sample Introduction Mass Spectroscopy," U.S. Pat. No. 6,207,954, separate API source probes introduce two or more compounds including a lock mass into the ion source chamber simultaneously. In "Multi-inlet mass spectrometer," European Patent Application No. 0 966 022, multiple Electrospray probes aligned at different angles spray toward a spinning chamber that has an opening that aligns with a portion of the probes. The charged-particle jets emitted by the portion of probes that are aligned with the opening enter the sampling orifice of the mass spectrometer. In each of these external introduction techniques, the analyte sample and the lock mass ions can be emitted from separate probes, reducing interaction between the lock mass and sample in solution and probe contamination.

However, both techniques require duplication of sample probes and injectors, a complex ion source interface, and both are adapted specifically for Electrospray ionization sources. Additionally, because the lock mass molecules are introduced within the ion source, some remnant level of contamination of the ion source and/or mass spectrometer interface is unavoidable. It would therefore be advantageous to provide a simplified lock mass introduction technique that does not depend on the ion source implementation and does not cause any source/interface contamination.

Furthermore, in the field of tandem mass spectroscopy (MS/MS) where the second MS stage is capable of exact mass determination, there is added complication with respect to the addition of lock masses. MS/MS involves selection of a narrow range of "parent" ions with a first mass analyzer or mass filter stage, fragmentation of the parent ions in a collision chamber, creating "daughter ions", and then analysis of the composition of the daughter ions in a second mass analyzer. In this, arrangement, a lock mass introduced at the ion source must pass through both the first mass analyzer and the collision cell, which requires that the lock mass and its daughter ions be in the same mass range as the parent ion of interest because they would otherwise be filtered and/or fragmented away. Therefore, the current method is to use the parent ion as the lock mass. This method requires that the parent ion be known, and also that the parent ion not be completely fragmented in the collision cell, since a portion must pass through to the second mass analyzer. These requirements decrease the number of daughter ions available and provide low ion statistics for both the parent and daughter ions. In addition, proper mass axis calibration requires the m/z ratio of the daughter ions to be within range of the parent ion. The number of lock masses available is thereby limited. It would accordingly be advantageous to provide a simple lock mass introduction technique for MS/MS that does not suffer from these constraints, and in particular, does not require use of the parent ion as the lock mass.

SUMMARY OF THE INVENTION

The present invention provides a mass calibration apparatus in which lock masses are internally introduced at a post-source stage of a mass spectrometer. Lock mass ions mix with the analyte ions in the ion optics prior to mass analysis.

In different embodiments, the source of lock mass ions may include various means for ionizing lock mass molecules including but not limited to photoionization, field desorption-ionization, electron ionization, and thermal ionization means.

The present invention also provides internal introduction of lock masses into a tandem mass spectrometer. The tandem mass spectrometer comprises a first mass analyzer, a collision cell and a second mass analyzer. The collision cell receives selected analyte ions from the first mass analyzer and includes collision gas that fragments the selected analyte ions into daughter ions. In some embodiments, the first mass analyzer and the collision cell are combined into a single unit that has the functions of both. Examples of these embodiments include use of a quadrupole ion trap or a linear ion trap. A lock mass source introduces lock mass molecules directly into the collision cell without subjecting the lock mass molecules to fragmentation by the collision gas, and a lock mass ionization unit ionizes the lock mass within the collision cell. In some embodiments, the lock mass introduction and ionization can be into ion optics located after the collision cell and before the second mass analyzer.

The present invention also provides a method for mass calibration of analyte ions with lock masses in a mass spectrometer having an analyte ion source, ion optics, and a mass analyzer, by creating lock mass ions within the ion optics. According to one embodiment, the step of creating lock mass ions comprises introducing lock mass molecules into the ion optics. According to a second embodiment, the step of creating lock mass ions comprises ionizing lock mass molecules within the ion optics. These steps are not exclusive and according to another embodiment lock mass ions are created by introducing lock mass molecules into the ion optics and ionizing the lock mass molecules introduced within the ion optics. In these methods, lock mass ions are ionized substantially in or near the downstream path of the analyte ions so that both analyte ions and lock mass ions thereafter travel along the same path downstream and are detected and analyzed together.

In addition, the present invention provides a method for mass calibration of a tandem mass spectrometer that includes a collision cell by creating lock mass ions within the collision cell. According to one embodiment, the step of creating lock mass ions comprises introducing lock mass molecules into the collision cell. According to a second embodiment, the step of creating lock mass ions comprises ionizing lock mass molecules within the collision cell. These steps are not exclusive and according to another embodiment, lock mass ions are created by introducing lock mass molecules into the collision cell and ionizing the lock mass molecules within the collision cell.

The present invention also provides a method for mass calibration of a tandem mass spectrometer that includes ion optics for transporting analyte daughter ions to a mass analyzer by creating lock mass ions within the ion optics. The lock mass ions are created by introducing lock mass molecules into the ion optics and/or ionizing lock mass molecules within the ion optics.

According to these methods for calibrating a tandem mass spectrometer, lock mass molecules are introduced and ionized in the path of analyte daughter ions. The lock mass ions are then guided and transported together with the analyte daughter ions for detection and analysis.

BRIEF DESCRIPTION OF THE DRAWINGS

In the following figures, like reference numerals are used to indicate identical and/or analogous structures shown throughout the figures.

DETAILED DESCRIPTION

The purpose of the internal mass calibration systems discussed below is to provide a lock mass to the final mass analyzer stage that can be used to correct (calibrate) the mass-to-charge ratio scale of the mass analyzer. In different types of mass analyzers, different scales are used. For example, when a quadrupole analyzer is used, the translation between applied quadrupole voltages and mass-to-charge ratio is calibrated. In a Time-Of-Flight mass analyzer, the translation between ion drift time and mass-to-charge ratio is calibrated. As numerous factors such as temperature, voltage fluctuations, pressure and chamber length affect the calibration in ways that are difficult to calculate and predict, using a reference lock mass is a valuable means of ensuring the accuracy of the mass-to-charge ratios detected and calculated by a mass spectrometer.

Figure 1:
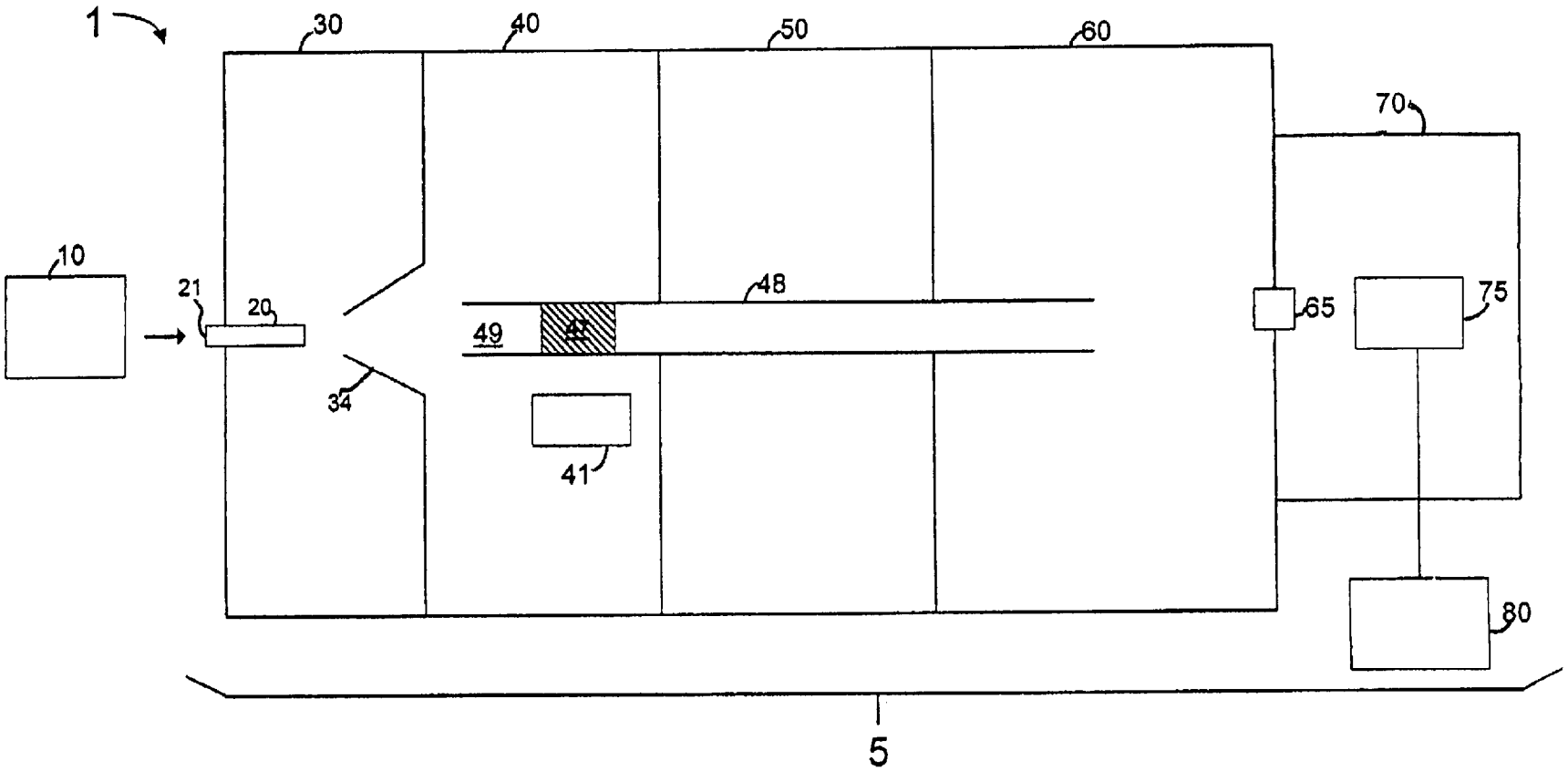
FIG. 1 is a block diagram of a mass spectrometer system that incorporates the present invention.

FIG. 1 illustrates an exemplary mass spectrometer system that incorporates the present invention. A mass spectrometer system 1 for analyzing the molecular composition and/or structure of an analyte sample includes an ion source 10 and a mass spectrometer 5. The ion source 10 is used to ionize sample molecules and to direct the resulting ions toward a mass spectrometer interface 20. Different types of ion sources that may be used in the context of the present invention include Electrospray, Atmospheric Pressure Chemical Ionization, Atmospheric Pressure Photoionization, Matrix Assisted Laser Desorption Ionization, and Atmospheric Pressure-Matrix Assisted Laser Desorption Ionization sources, among other known types. The ion source may be at substantially atmospheric pressure, but sources at pressures lower or higher than atmospheric are considered to be within the scope of use of the invention.

To ensure that a sufficient number of analyte ions enter the mass spectrometer 5 through the interface 20, the source 10 and interface may be maintained at a potential difference that drives the analyte ions toward an aperture 21 in the interface. Other structures or electrodes (not shown in FIG. 1) may be present with potential differences that assist in directing the analyte ions in the aperture 21. Gas flow can also be used to assist in driving the ions into the aperture 21. In FIG. 1, the interface 20 is shown as a capillary conduit which extends outward from the mass spectrometer 5 towards the ion source, but it may be just an aperture. The aperture 21 in the interface may typically be in the range 200–1000 $\mu$m in diameter, but larger or smaller diameters are useable. Additional means not shown may be incorporated into the mass spectrometer 5 or interface 20 to further assist desolvation of the analyte ions. Such means may include a heated capillary which causes solvent to evaporate during transport of the analyte ions within the mass spectrometer, and/or a heated gas counter-flow that dries the analyte ions just before they enter the mass spectrometer via the interface 20. In this manner, a high concentration of ionized analyte relative to the solvent enters the mass spectrometer 5.

Analyte ions pass through the interface 20 and are drawn into a first vacuum stage 30 of the mass spectrometer 5 that is typically at a pressure of approximately 0.5–5 torr. Within the first vacuum stage 30, the analyte ions usually undergo a free jet expansion. A skimmer 34 at the downstream end of the first vacuum stage intercepts the jet expansion, and the analyte ions that pass through the skimmer 34 enter into a second vacuum stage 40 that is typically at a pressure of approximately 0.1 to 0.5 torr. It is noted that the vacuum stages 30, 40, 50, 60 depicted in FIG. 1 are coupled to a system of vacuum pumps, as would be understood by those having ordinary skill in the art.

As the analyte ions enter vacuum stage 30, they are driven predominantly by gas flow and voltages on electrodes such as skimmer 34 and other ion optics elements that might be present for aiding transport of the ions. (Such elements that could be present in vacuum stage 30 are not shown in FIG. 1.) Analyte ions that pass through skimmer 34 into vacuum chamber 40 are assisted further in their motion by ion optics 48. In the following, ion optics 48 should be interpreted to include all ion optics elements between interface 20 and mass analyzer 75, including skimmer 34 and other elements in vacuum stage 30 that are not illustrated in the Figures.

A source 41 of lock mass ions is located adjacent ion optics 48. "Adjacent" in this context is defined as comprising one or more of the following: "next to", "in the vicinity of", "surrounding", "in part surrounding", "including part of", "connected to", and "functionally associated with". The function of source 41 is to create ions in, or supply ions to, a region 47 that is within ion optics 48. Part of source 41 can thus be located outside of the mass spectrometer vacuum chambers. An example could be a laser or ultraviolet radiation source whose emissions are directed into region 47 through appropriate windows and optics. Another example is a source of lock mass gas that supplies gas into the system and thereby introduces lock mass molecules into region 47 where they can be ionized.

Figure 2:
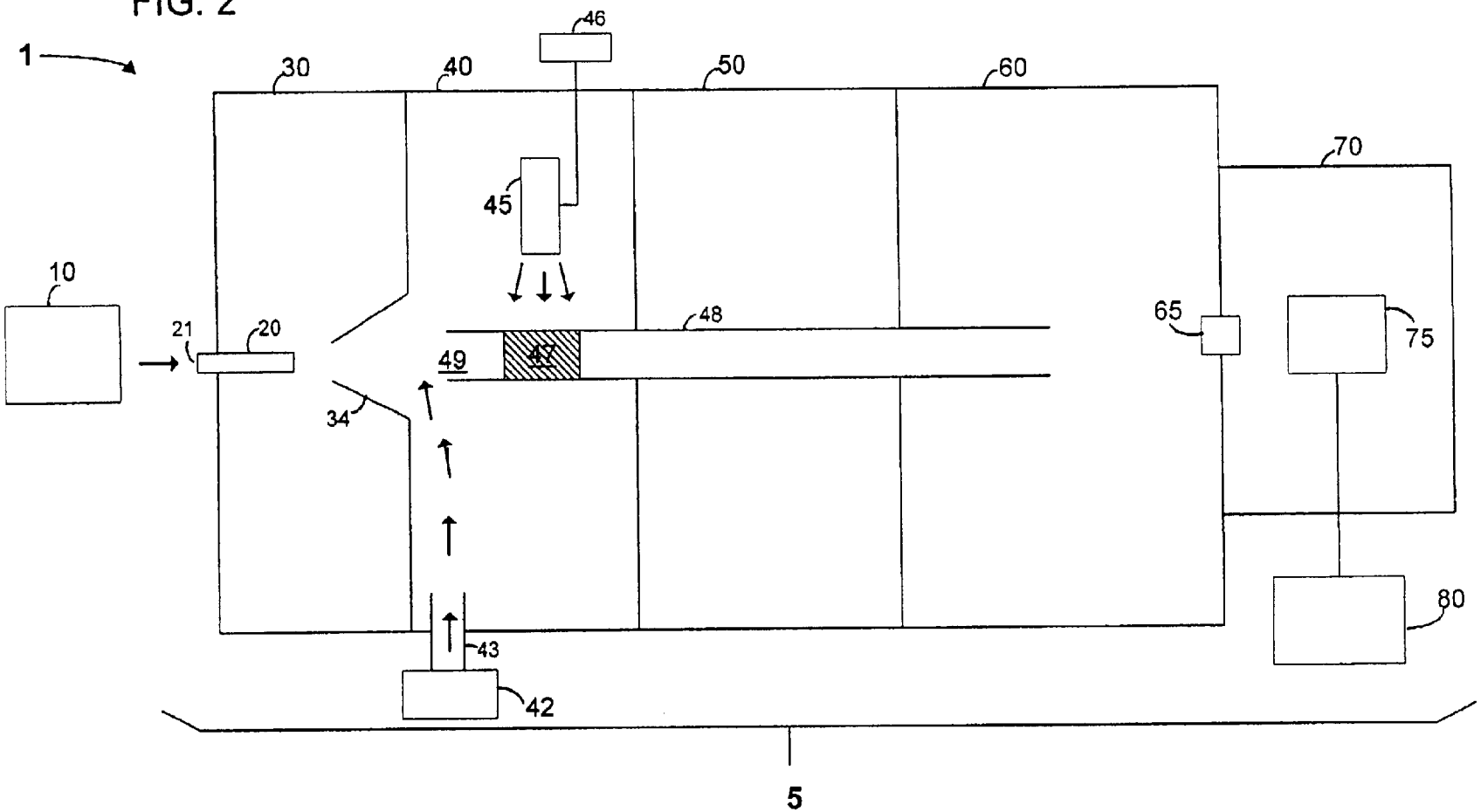
FIG. 2 is a block diagram of the mass spectrometer system of FIG. 1 that incorporates an embodiment of the invention.

In one embodiment, shown in FIG. 2, lock mass molecules supplied from a lock mass source are introduced in a gaseous phase into the second vacuum stage through an inlet 43. The lock mass can be any chemical species that is volatile under reduced pressure and/or elevated temperature levels, chemically stable and ionizable when exposed to photons or ionized reagent gas such as acetone. For example, organic chemicals having molecular weights up to 5000 Da such as fluorinated phosphazines, polyethylene glycols, alkyl amines or fluorinated carboxylic acids may be used. These chemical species are presented by way of example and any number of other equally suitable chemicals may be used in the context of the invention. For example, commonly assigned U.S. Pat. No. 5,872,357 to Flanagan, incorporated herein by reference in its entirety, describes other suitable lock mass materials that can best used in the manner of the present invention to avoid contamination and charge competition. When organic chemicals are used it is advantageous to reduce the contribution of carbon isotope $C_{13}$ to prevent inaccuracies during analysis. Typical organic chemicals used for lock masses have ionization potentials in the range of 7.5 to 12 eV, the majority having ionization potentials below 10 eV, making these chemicals particularly suitable for ionization by ultraviolet radiation having photon energies at such levels.

As the injected lock mass molecules flow into the second vacuum stage 40 they mix with analyte ions at a point near to or within the ion optics path 49 of ion optics 48. Within the ion optics path 49, the lock mass molecules become ionized by a lock mass ionization source 45 that irradiates a short span, or ionization region 47, within a single vacuum stage along the axis of the mass spectrometer. The ionization region 47 is confined to a short span along the axis to ensure that lock mass ions have approximately the same collisional conditioning as the analyte ions and are produced at about constant pressure. The radial distance of the ionization source 45 from the central axis depends upon the intensity of radiation it supplies, but in general, the ionization source is placed in close proximity to the ionization region 47 so that maximum radiation is delivered to the region. The ionization source 45 (and ionization region 47) may be situated within the second vacuum stage 40 (as shown) or it may be situated in one of the downstream vacuum stages, e.g., 50, 60. (Collisional conditioning and criteria for location of the ionization source 45 are discussed below.) According to one embodiment, the ionization source 45 is a vacuum ultraviolet (VUV) source, such as, for example, a plasma lamp. Krypton plasma lamps, which produce photons in the range of 10 to 10.6 eV are particularly suitable for the pertinent range of lock mass ionization potentials. Alternatively, a laser ionization technique, such as resonance-enhanced multiphoton ionization (REMPI), may be employed. In either case, a photon flux in the range of $10^9$ photons/cm$^2$/s can produce a sufficient ion current required for accurate detection. The ionization source 45 receives electrical power from an external energy source 46. The ionization sources described produce positive lock mass ions by removing electrons from lock mass molecules. Other means of ionization, such as electron impact, can be employed as is known in the art. Alternatively, ionization sources that produce negative lock mass ions by electrical or thermal means may be employed.

According to one embodiment using a photoionization source, a lock mass ionization source 45 is situated within the second vacuum stage 40 in a position that enables photons radiated from the source to intersect with the lock mass molecules within the ion optics path 49. To maximize exposure, it may be advantageous to introduce the lock mass gas at right angles to the central axis of the ion guide 48 and to direct the maximal intensity of the ionization source at right angles with respect to both of these directions. Since photons at energies greater than 7.5 eV tend to become scattered and/or absorbed by background gas components at the pressures prevailing in the second vacuum stage, it can be advantageous to situate the ionization source 45 closely to the ion optics, within a 100 mm range, for example. The ionization source 45 can, however, be situated outside the vacuum system. In that case, the ionizing radiation is transported to the ionization region 47 by means of suitable optics.

Figure 3:
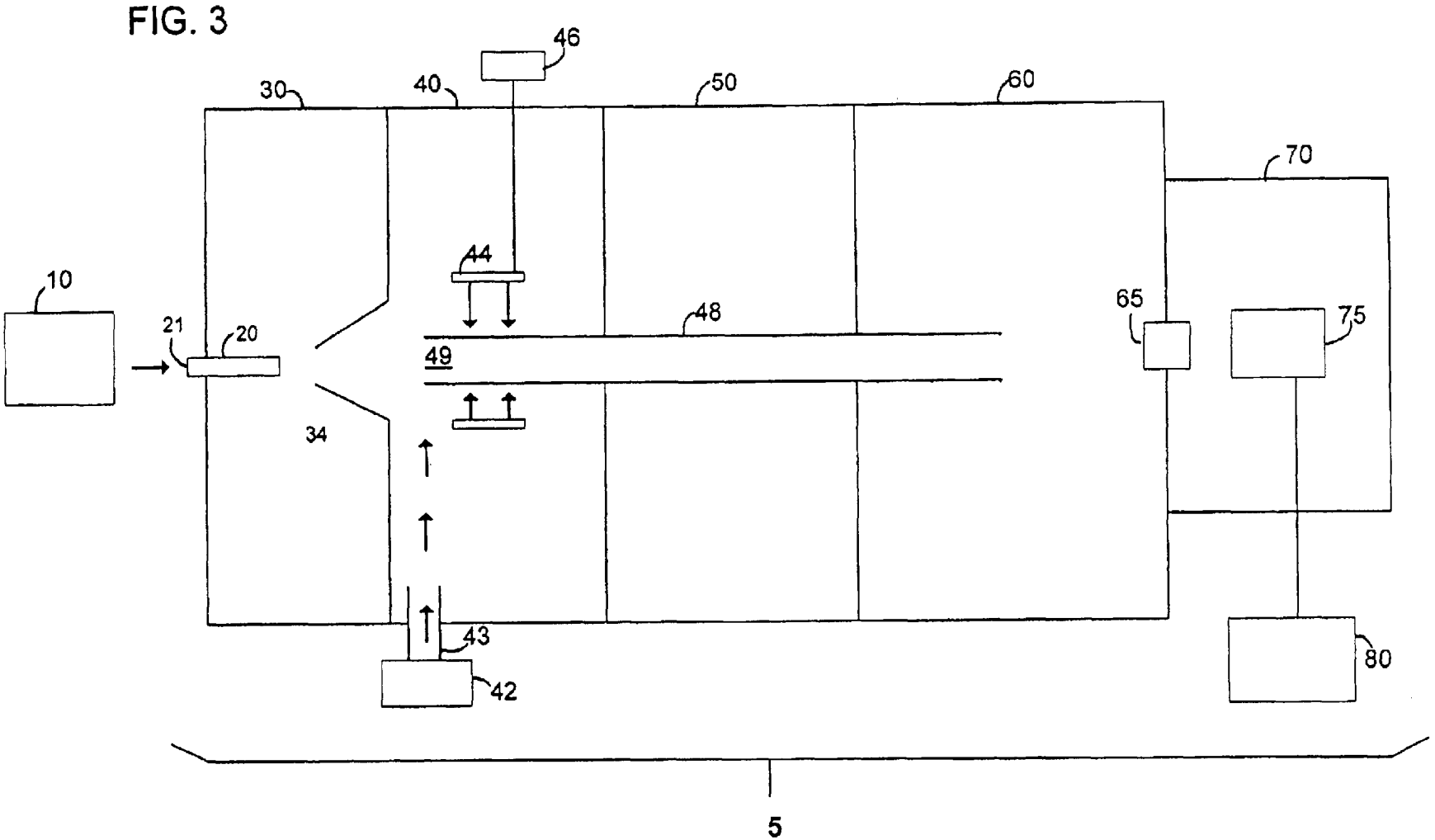
FIG. 3 illustrates an embodiment of the mass spectrometer system of FIG. 1 in which a concentric, coaxial radiation lamp is used as an ionization source.

FIG. 3 illustrates an embodiment of the mass spectrometer system according to the present invention in which a concentric VUV lamp is used as the ionization source. In FIG. 3, the concentric VUV lamp 44 is coaxial with, and surrounds a portion of the ion optics 48. As in the previously described embodiment, the axial length of the VUV lamp 44 is limited to a short span in order to define a corresponding ionization region.

Both analyte ions and lock mass ions are guided downstream along the ion optics path 49 defined by the ion optics 48. The optics may include electrodes and circuits that apply electrostatic and/or RF and/or magnetic fields to the ions along the path 49. Typical suitable optics include multipole ion guides such as octopole and hexapole ion guides. Multipole guides can be used in combination with various means known in the art for creating axial electric fields along the ion optics path 49. Suitable guides include, for example, ion funnels such as those described in U.S. Pat. No. 6,107,628.

There are at least three aspects of the function of the ion optics 48. Firstly, ion transport: to assist motion of the ions in a generally axial direction and prevent radial loss of the ions as they progress from ion source to mass analyzer. Fields generally orthogonal to the axis of the ion optics path 49 serve to confine the ions to regions near the axis, and axial electric fields, often in combination with gas motion, serve to keep ions moving along from ion source to mass analyzer. Secondly, vacuum staging: to assist in stripping off gas accompanying the ions and help accomplish the reduction of pressure from about atmospheric in the ion source to about $10^{-5}$ torr or below typical of a mass analyzer. The action of the optics or guides in this regard is to allow the gas to escape into the vacuum chambers and be pumped away while the ions are constrained to move along the optical path. Typically, a plurality of vacuum chambers is required for the total pressure reduction. The ion optics and/or ion guides facilitate transport of the ions between chambers. The exact number of chambers can vary and is not of importance to the present invention. Thirdly, cooling and focusing: the ion optics or guides play a role in conditioning the motion of the ions. In common mass spectrometry practice, collisions of the ions with background gas in an ion guide result in radial and axial cooling and focusing of ions along the axis of the guide. (Focusing in this context means reduction of the radial extent of the beam.) The background gas pressure in the region where this action occurs is typically several millitorr or more. Ion cooling by collision is described in U.S. Pat. No. 4,963,736.

The cooling and focusing aspect of the ion optics arrangement can be of significance for the present invention. Cooling and focusing are desirable for achieving good resolution and sensitivity with most types of mass analyzers, and especially important for time-of-flight mass analyzers. Substantial ion motion conditioning is necessary for good resolution in TOF analyzers. This conditioning is achieved by collisional cooling and focusing of the ions before introduction into the analyzer, usually in combination with "slicing" (reduction of the transverse dimensions and divergences) of the ion beam with appropriate apertures. The kind of cooling (reduction of velocity spread of ions, especially in directions transverse to the axis) achieved with collisions cannot be accomplished by use of ion optics alone (excepting slicing), a consequence of Liouville's Theorem of constant particle density in phase space.

The motion of a particle such as an ion can be described by the three coordinates of position x,y,z together with its corresponding momentum components $p_x,p_y,p_z$. One such description of motion is the path of the point representing the particle in the 6-dimensional space of the coordinates and the momentum components. This space is called the phase space of the particle. With a system of n such particles, the motion of the system is the set of paths taken by the representative points of the particles in phase space (assuming that the particles do not interact with each other). Liouville's Theorem states: "Under the action of forces that can be derived from a Hamiltonian, the motion of a group of particles is such that the local density of the representative points in the appropriate phase space remains everywhere constant." Forces on ions due to macroscopic electric and magnetic fields external to the ion beam fall into this category. In describing the motion of ions in mass spectrometer systems, coordinate axes can usually be chosen such that the x,y, and z motions are independent of each other. Then each phase space plane $(x,p_x)$, $(y,p_y)$ and $(z,p_z)$ can be considered separately. For this usual circumstance, Liouville's theorem means that regions of each of these planes occupied by representative points of the ions may change in shape, but not in area, as the motions of the ions proceed. The magnitude of the areas can only change by the action of nonconservative forces (e.g., collisions) or by removal of ions from the beam (e.g., slicing).

In the following, "phase space of ions" should be interpreted to mean "the region of the phase space plane that is occupied by the representative points of the ions". The particular phase space plane referred to in the description of the invention is a phase space plane associated with a coordinate axis orthogonal to the longitudinal axis of the ion guide or ion optics. Such orthogonal axes may also be called "transverse".

If the lock mass ions are not cooled and focused in the identical fashion as the analyte ions (i.e., their respective phase spaces transverse to the axis are not essentially congruent), the instrumental mass resolution will likely be different for the two species. Under some circumstances, erroneous mass calibrations could result. It is thus important that the lock mass ions be subjected to substantially the same cooling and focusing as the analyte ions. This is accomplished by creating the lock mass ions in the ion guide before significant cooling and focusing takes place, i.e., before the ions reach a region of pressure appropriate for cooling, nominally about 5 millitorr or greater. The optimal position for ionization of the lock mass molecules in a particular embodiment of the ion optics 48 is thus readily determined by one of ordinary skill in the art.

Thus, to condition the motions of the lock mass ions and the analyte ions in a comparable manner in the example system of FIG. 1, the lock mass and analyte ions are directed along the same ion optics path 49. They are therefore subjected to approximately the same average history of collisions with the background gas. In this example, much of the collisional cooling occurs before the third vacuum stage 50, which is maintained at about 5 millitorr or somewhat less. To facilitate cooling, the third vacuum stage 50 may be longer than the other stages in order to lengthen the ion optic path 49 and thereby increase the probability of collision between the ions and the gas molecules.

From the third vacuum stage 50, the analyte and lock mass ions enter a fourth high vacuum stage 60 in which the pressure drops to less than about $10^{-4}$ torr, or less than about $10^{-5}$ torr in some applications. An interface 65 to a vacuum chamber 70 containing a mass analyzer 75 is positioned at the downstream end of the fourth vacuum stage. Any type of mass analyzer can be used; examples include ion trap, quadrupole mass filter, magnetic sector, TOF, and Fourier Transform Ion Cyclotron Resonance (FTICR) analyzers. Actual choices of pressure near or in the mass analyzer will depend upon the type of mass analyzer used, and will range from greater than $10^{-4}$ torr in the case of an ion trap analyzer to less than $10^{-8}$ torr for an FTICR analyzer, with intermediate values in the cases of quad mass filters and TOF analyzers. If a TOF analyzer is used, the interface 65 may comprise a slicer that is used to limit the transverse extent of the ion beam before entrance to an orthogonal acceleration chamber. Analyte and lock mass ions are selected and then detected with a detection means, such as a multiplier-type ion detector, in the mass analyzer 75. The detection means (not shown in FIGS. 1, 2 and 3) sends signals to a data acquisition and processing unit 80 which receives the signals and processes the data into a useful format, for example, a graph of the amplitude of detected signals at various mass-to-charge ratios. The data processing unit 80 may be directly connected to or integrated into the mass spectrometer unit, or it may be connected to the mass spectrometer via a network, in which case the mass spectrometer can include a network interface. Again it is emphasized that FIG. 1 represents an example of one embodiment of the invention and that the actual number of vacuum chambers may vary in other embodiments.

Figure 4:
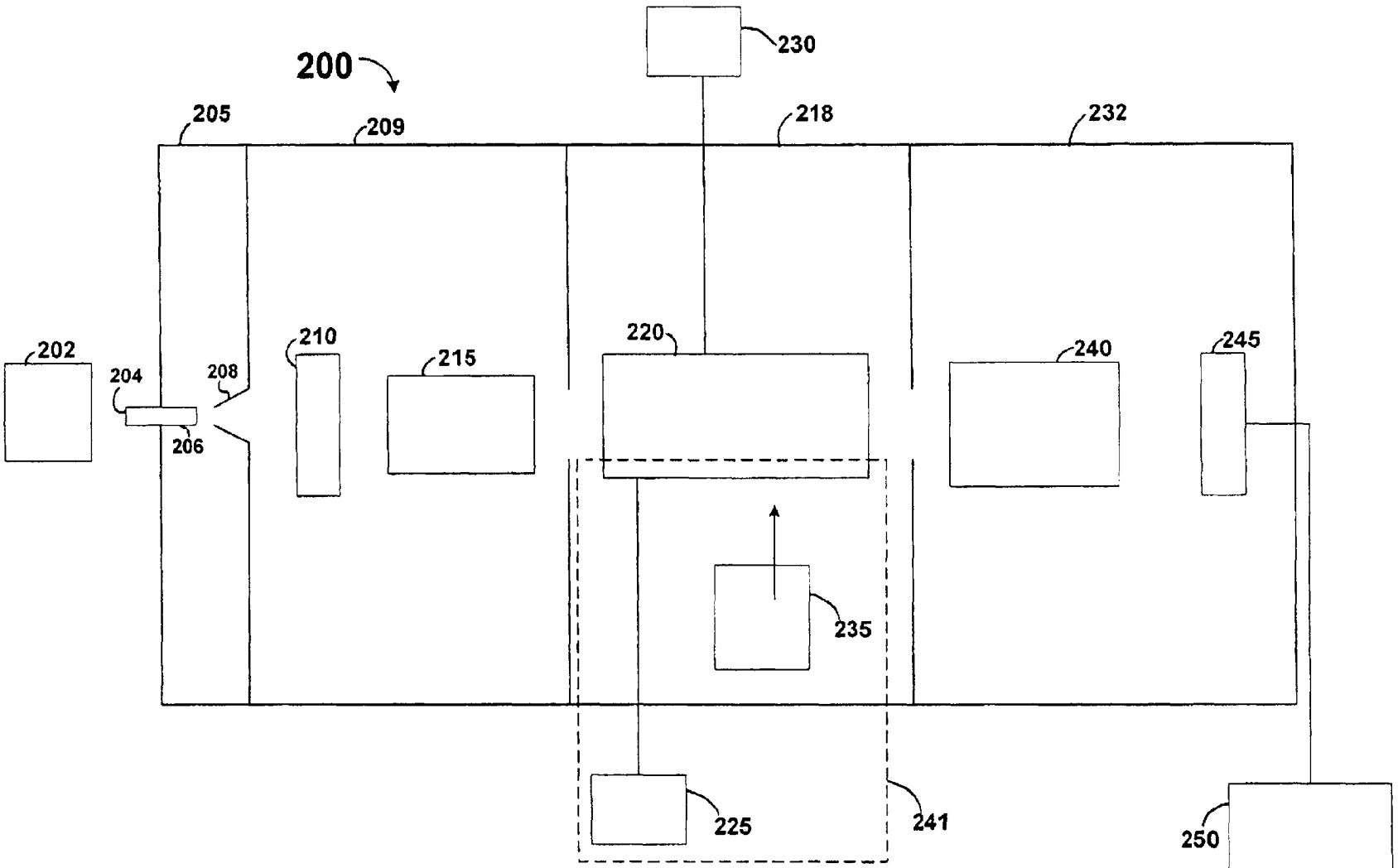
FIG. 4 illustrates an exemplary embodiment of a tandem mass spectrometer system (MS/MS) that incorporates the present invention.

FIG. 4 schematically illustrates an embodiment of a tandem mass spectrometer system 200 that provides lock mass calibration in accordance with the present invention. As shown, an analyte ion source 202 introduces analyte ions into a vacuum interface chamber 205 through an aperture 204 of a longitudinally positioned capillary conduit 206. Analyte ions flow through the interface chamber 205 and skimmer 208 into a first mass analyzer 215 in vacuum chamber 209. Optionally, ion optics 210 are included for focusing and accelerating analyte ions into the mass analyzer 215. Analyte ions within a desired mass range are selected for passage through the mass analyzer, the remainder of the ions being filtered away. The selected analyte ions that travel through the first mass analyzer 215 then enter a collision cell 220 in vacuum chamber 218 after being accelerated to a kinetic energy appropriate for collisional dissociation. In the collision cell 220, at least a portion of the "parent" analyte ions are fragmented into "daughter" ions by collisions with a gas, which may be an inert gas such as nitrogen, supplied from a collision gas source 230 and maintained at an appropriate pressure. As is known in the art, the collision gas pressure and length of the collision cell 220 are chosen to yield sufficient dissociative collisions to produce a desired amount of daughter ions. The daughter ions are then transported by gas flow or by ion optics (not shown) to a second mass analyzer 240 in vacuum chamber 232. In some embodiments, the daughter ion transport may be assisted by DC electric fields in the collision cell 220. Lock mass ions are created in, or introduced into, the collision cell 220 from a source 241 of lock mass ions adjacent (in the same sense as described above) the collision cell 220. In some embodiments, the source 241 of lock mass ions may comprise a lock mass source 225 for supplying lock mass molecules to collision cell 220 and a lock mass ionization source 235 for ionizing lock mass molecules within the collision cell 220. The lock mass source 225 may, for example, be a gas source. The lock mass ionization source 235 may be an ultraviolet radiation source or laser, for example. The lock mass ions are transported together with the analyte daughter ions to the second mass analyzer 240, again by means of gas flow, DC electric fields in the collision cell 220, ion optics (not shown), or combinations thereof. The ions enter second mass analyzer 240, which selects lock mass ions and the analyte daughter ions for passage to a detector 245. Data analysis may follow in a data acquisition and processing unit 250 connected to or included within the detector 245.

Analyzers 215 and 240 can be any types of mass analyzer or mass filter. An exemplary embodiment incorporates a quadrupole mass filter at 215 and a time-of-flight mass analyzer at 240. In some embodiments, the first analyzer 215 and collision cell 220 may be combined into a single device that has the functions of both: mass selection and ion fragmentation. Examples include quadrupole ion traps and linear ion traps. An exemplary embodiment of this type could include an ion trap at 215 and a time-of-flight mass analyzer at 240, with optional beam conditioning ion optics in between. A distinct collision cell would then not be necessary. The actual number of distinct vacuum chambers will vary with embodiment.

Figure 5:
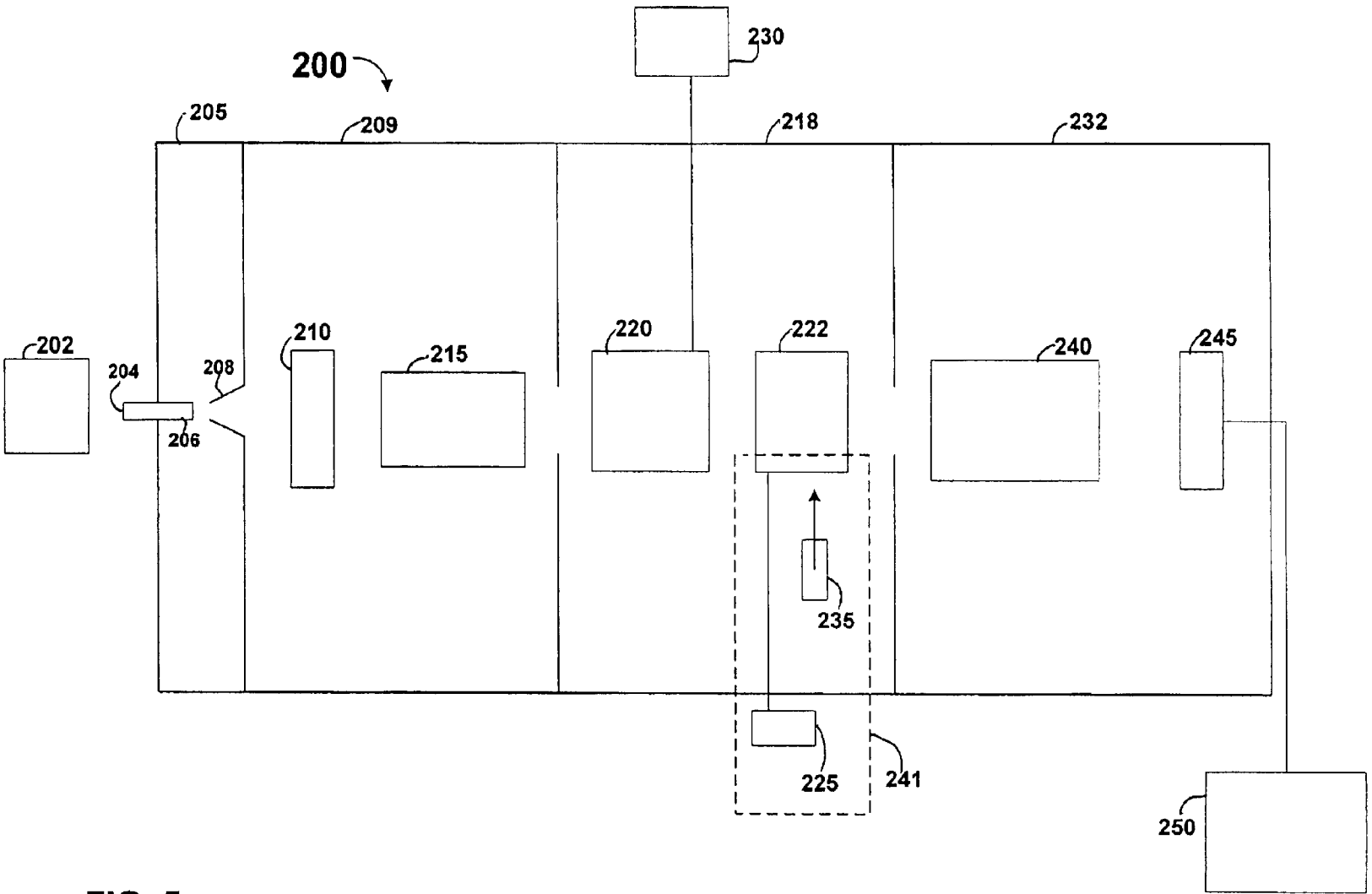
FIG. 5 illustrates an embodiment of a tandem mass spectrometer system that incorporates the present invention.

Usually, the lock mass molecules can be introduced anywhere in the collision cell 220 and can be ionized at any or all positions along the longitudinal axis of the cell. Since the lock mass ions will have essentially thermal initial kinetic energy, they will not be subjected to collisional dissociation. For embodiments where fields (DC, AC or RF) within the collision cell 220 are used for dissociation of the analyte ions, it may be advantageous to ionize the lock mass molecules at or near the downstream end of the cell, so that no significant fraction of the lock mass ions is dissociated before leaving the cell. In embodiments where beam conditioning ion optics are placed downstream from the collision cell 220, between the cell and the second mass analyzer 240, lock mass ions can be created in the optics rather than in the collision cell. One such embodiment is illustrated schematically in FIG. 5. Ion optics 222 for beam conditioning are placed between the collision cell 220 and second mass analyzer 240. Lock mass ions are created in, or introduced into, ion optics 222 from a source 241 of lock mass ions adjacent (in the above sense) the ion optics 222. In some embodiments, the source 241 of lock mass ions may comprise a lock mass source 225 for supplying lock mass molecules to ion optics 222 and a lock mass ionization source 235 for ionizing lock mass molecules within the ion optics 222. The lock mass source 225 may, for example, be a gas source. The lock mass ionization source 235 may be an ultraviolet radiation source or laser, for example. The lock mass ions are transported together with the analyte daughter ions to the second mass analyzer 240 by means of gas flow, DC electric fields, the ion optics 222, or combinations thereof. Mass analysis of the ions follows as described above. In some embodiments, first mass analyzer 215 and collision cell 220 may be combined into a single device such as an ion trap, as described above. The scope of the term "collision cell" in the claims includes the embodiments where functions of a collision cell, e.g., ion fragmentation, are performed in another device or apparatus.

Distinct methods of calibrating mass spectrometer systems by internal introduction of lock masses have been mentioned in connection with the several embodiments of mass spectrometer systems described above. According to a first method, lock mass molecules are introduced into a post-source vacuum stage of a mass spectrometer system and then ionized in or near the downstream path of the analyte ions so that both analyte ions and lock mass ions thereafter travel along the same path downstream and are detected and analyzed together. In a second method, for calibrating a tandem mass spectrometer, lock mass molecules are introduced and ionized in the path of analyte daughter ions. The lock mass ions are then guided and transported together with the analyte daughter ions for detection and analysis.

The use of internal lock mass introduction in the exemplary methods described above can provide advantages over introduction into the ion source. Though possible, switching between analyte sample and lock mass solutions is not necessary, and no washout time is required between introduction of analyte and lock mass samples since the lock mass material does not contaminate the ion source or its interface with the mass spectrometer. The throughput and speed of sample analysis is correspondingly increased. All types of ion sources can be employed, without restriction imposed by lock mass ionization requirements or contamination problems. There are no issues with reaction between the lock mass material and the analyte and no problems with competition for ionization. These advantages are mentioned by way of example and not of limitation. The named advantages are not to be regarded as necessary to the invention.

In the foregoing description, the method and system of the invention have been described with reference to a number of examples that are not to be considered limiting. Rather, it is to be understood and expected that variations in the principles of the method and system herein disclosed may be made by one skilled in the art and it is intended that such modifications, changes, and/or substitutions are to be included within the scope of the present invention as set forth in the appended claims.

What is claimed is:

1. A mass calibration apparatus for a mass analyzer, comprising:

an ion source for providing analyte ions to the mass analyzer;

ion optics, situated between the ion source and the mass analyzer, for assisting the motion of the analyte ions from the ion source to the mass analyzer; and a source of lock mass ions including a lock mass source and a lock mass ionization source adjacent the ion optics for creating lock mass ions within the ion optics;

wherein the lock mass ionization source comprises a photoionization source.

2. The mass calibration apparatus of claim 1, wherein the lock mass source comprises a gas source and the ion optics has a central axis, the gas source introducing gas orthogonally with respect to the central axis of the ion optics.

3. The mass calibration apparatus of claim 1, wherein the ion optics includes at least two vacuum stages, a first of the at least two vacuum stages being situated upstream with respect to a second of the at least two vacuum stages.

4. The mass calibration apparatus of claim 3, wherein the lock mass ionization source is situated in the second vacuum stage of the ion optics.

5. The mass calibration apparatus of claim 3, wherein the lock mass ionization source is situated externally and adjacent to the second vacuum stage of the ion optics.

6. A method for mass calibration of analyte ions with lock masses in a mass spectrometer that includes an analyte ion source, ion optics and a mass analyzer, said method comprising:

introducing lock mass molecules into the ion optics; and photoionizing the lock mass molecules within the ion optics.

7. The method of claim 6, wherein the ion optics includes at least two vacuum stages, a first of the at least two vacuum stages being situated upstream with respect to a second of the at least two vacuum stages.

8. The method of claim 7, wherein the photoionization of the lock mass molecules within the ion optics takes place within the second vacuum stage.

9. The method of claim 6, wherein the lock mass molecules are introduced into the ion optics in gaseous form.

10. The method of claim 7, further comprising:

directing the gas including the lock mass molecules orthogonally with respect to a longitudinal axis of the ion optics.

* * * * *